US011062839B2

(12) United States Patent
Chou

(10) Patent No.: US 11,062,839 B2
(45) Date of Patent: Jul. 13, 2021

(54) TRANSFORMER WINDING STRUCTURE FOR ENHANCING WINDING STABILITY

(71) Applicant: INNOTRANS TECHNOLOGY CO., LTD., New Taipei (TW)

(72) Inventor: Tsung-Han Chou, Keelung (TW)

(73) Assignee: INNOTRANS TECHNOLOGY CO., LTD., New Taipei (TW)

( * ) Notice: Subject to any disclaimer, the term of this patent is extended or adjusted under 35 U.S.C. 154(b) by 428 days.

(21) Appl. No.: 16/233,424

(22) Filed: Dec. 27, 2018

(65) Prior Publication Data

US 2019/0214189 A1 Jul. 11, 2019

(30) Foreign Application Priority Data

Jan. 5, 2018 (TW) ..... 107100490

(51) Int. Cl.

*H01F 17/04* (2006.01)
*H01F 27/30* (2006.01)
*H01F 27/28* (2006.01)
*H01F 27/32* (2006.01)

(52) U.S. Cl.

CPC ..... *H01F 27/306* (2013.01); *H01F 17/045* (2013.01); *H01F 27/2823* (2013.01); *H01F 27/32* (2013.01); *H01F 27/325* (2013.01); *H01F 27/2828* (2013.01)

(58) Field of Classification Search

CPC ..... H01F 27/325
USPC ..... 336/221
See application file for complete search history.

(56) References Cited

U.S. PATENT DOCUMENTS 4,363,014 A * 12/1982 Leach ..... H01F 27/02 174/138 F
5,815,061 A * 9/1998 Ho ..... H01F 27/325 336/192
5,852,335 A * 12/1998 Suzuki ..... H02K 1/148 310/254.1
6,344,787 B1 * 2/2002 McGrane ..... H01F 27/02 336/192
7,639,111 B2 * 12/2009 Hsu ..... H01F 27/326 336/192
8,031,040 B1 * 10/2011 Folker ..... H01F 5/02 336/198
8,212,643 B1 * 7/2012 Folker ..... H01F 27/2823 336/198
8,289,120 B2 * 10/2012 Tada ..... H01F 27/06 336/198

(Continued)

*Primary Examiner* — Ronald Hinson
(74) *Attorney, Agent, or Firm* — Muncy, Geissler, Olds and Lowe, P.C.

(57) ABSTRACT

A transformer winding structure for enhancing winding stability includes a wire frame having a first winding area and a second winding area, a first wire group wound in the first winding area, a second wire group wound in the second winding area, and a third wire group wound in the second winding area and wound in an overlaying manner on the second wire group. The wire frame forms the first winding area and the second winding area by a first plate, a second plate, and a winding column connected to the first plate and the second plate and having a spacer portion. The second plate comprises at least one protrusion protruding from the second plate toward the first plate. The second wire group and the third wire group approach the spacer portion when passing through the position of the protrusion.

7 Claims, 5 Drawing Sheets

(56) References Cited

U.S. PATENT DOCUMENTS

| | | | | |
|---|---|---|---|---|
| 9,183,974 | B1 * | 11/2015 | Folker | H01F 27/306 |
| 2002/0017975 | A1 * | 2/2002 | Chiang | H01F 5/02 336/198 |
| 2009/0108976 | A1 * | 4/2009 | Nerone | H01F 27/326 336/192 |
| 2009/0295530 | A1 * | 12/2009 | Faccin | H01F 27/325 336/220 |
| 2014/0160644 | A1 * | 6/2014 | Nam | H05K 5/02 361/679.01 |
| 2015/0248965 | A1 * | 9/2015 | Chou | H01F 27/324 336/117 |
| 2017/0243687 | A1 * | 8/2017 | Rylko | H01F 27/2823 |

* cited by examiner

PRIOR ART Fig. 1

TRANSFORMER WINDING STRUCTURE FOR ENHANCING WINDING STABILITY

FIELD OF THE INVENTION

The present invention relates to a transformer winding structure for enhancing winding stability.

BACKGROUND OF THE INVENTION

Referring to FIG. 1, in a current transformer structure, a first wire group 11, a second wire group 12 spaced from the first wire group 11, and a third wire group 13 overlaying the second wire group 12 are respectively wound on a wire frame 10. The first wire group 11 serves as a primary side 14, and the second wire group 12 and the third wire group 13 serve as a secondary side 15.

However, the first wire group 11 is usually implemented by an enameled wire having a smaller linewidth, and the second wire group 12 and the third wire group 13 are usually implemented by enameled wires having larger linewidths. During a wire winding process, the first wire group 11 is independently wound on the wire frame 10, the second wire group 12 is then wound on the wire frame 10, followed by covering the second wire group 12 by an insulation tape 16. Next, the third wire group 13 is wound on the second wire group 12, thus overlaying the third wire group 13 on the second wire group 12. At this point, the second wire group 12 is spaced by a first distance D1 from the first wire group 11, and the third wire group 13 is spaced by a second distance D2 from the first wire group 11.

The second wire group 12 and the third wire group 13 are separately wound. Thus, during the wire winding process, the winding stabilities of the second wire group 12 and the third wire group 13 are not consistent, in a way that an apparent difference is generated between the first distance D1 and the second distance D2. The above difference causes a leakage inductance difference between the second wire group 12 and the third wire group 13, affecting characteristics of the transformer as well as inaccurate control on the overall leakage inductance of the transformer.

SUMMARY OF THE INVENTION

It is a primary object of the present invention to provide a transformer winding structure for enhancing winding stability.

According to the above object, the present invention provides a transformer winding structure for enhancing winding stability. The transformer winding structure includes a wire frame, a first wire group, a second wire group, and a third wire group overlaying the second wire group. The wire frame includes a first plate, a second plate opposite to the first plate, and a winding column connected to the first plate and the second plate and having a spacer portion. As such, a first winding area is formed between the spacer portion and the first plate, and a second winding area is formed between the spacer portion and the second plate. Further, the second plate comprises at least one protrusion protruding from the second plate toward the first plate. The first wire group is wound in the first winding area. The second wire group is wound in the second winding area, and approaches the spacer portion when passing through a position of the protrusion. The third wire group is wound in the second winding area, and approaches the spacer portion when passing through the position of the protrusion.

In one embodiment, the protrusion has a connecting curved surface connected to the winding column, a leveled surface parallel to the second plate, and two side surfaces respectively located on one side of the leveled surface and connected to the second plate, wherein one of the two side surfaces that is away from the winding column is an inclined surface.

In one embodiment, the transformer winding structure includes a plurality of first electrodes provided on the first plate and a plurality of second electrodes provided on the second plate.

In one embodiment, the first plate includes a first wire outlet and a first top end opposite to the first wire outlet, and the plurality of first electrodes are provided at the first wire outlet.

In one embodiment, the second plate includes a second wire outlet and a second top end opposite to the second wire outlet, and the plurality of second electrodes are provided at the second wire outlet.

In one embodiment, the spacer portion includes a first spacer plate and a second spacer plate, and a leakage inductance adjustment gap is formed between the first spacer plate and the second spacer plate.

In one embodiment, the first spacer plate and the first plate are adjacent, and the second spacer plate and the second plate are adjacent.

With the above technical solution, the present invention substantially achieves the following effects compared to the prior art. In the present invention, through the protrusion protruded from the second plate toward the first plate, the second wire group and the third wire group are caused to approach the direction of the spacer portion, thus ensuring the winding densities of the second wire group and the third wire group, as well as avoiding an apparent difference between the second wire group and the third wire group relative to the first wire group and mitigating the issue of leakage inductance difference.

DETAILED DESCRIPTION OF THE PREFERRED EMBODIMENTS

Details and technical contents of the present invention are given with the accompanying drawings below.

Figure 1:
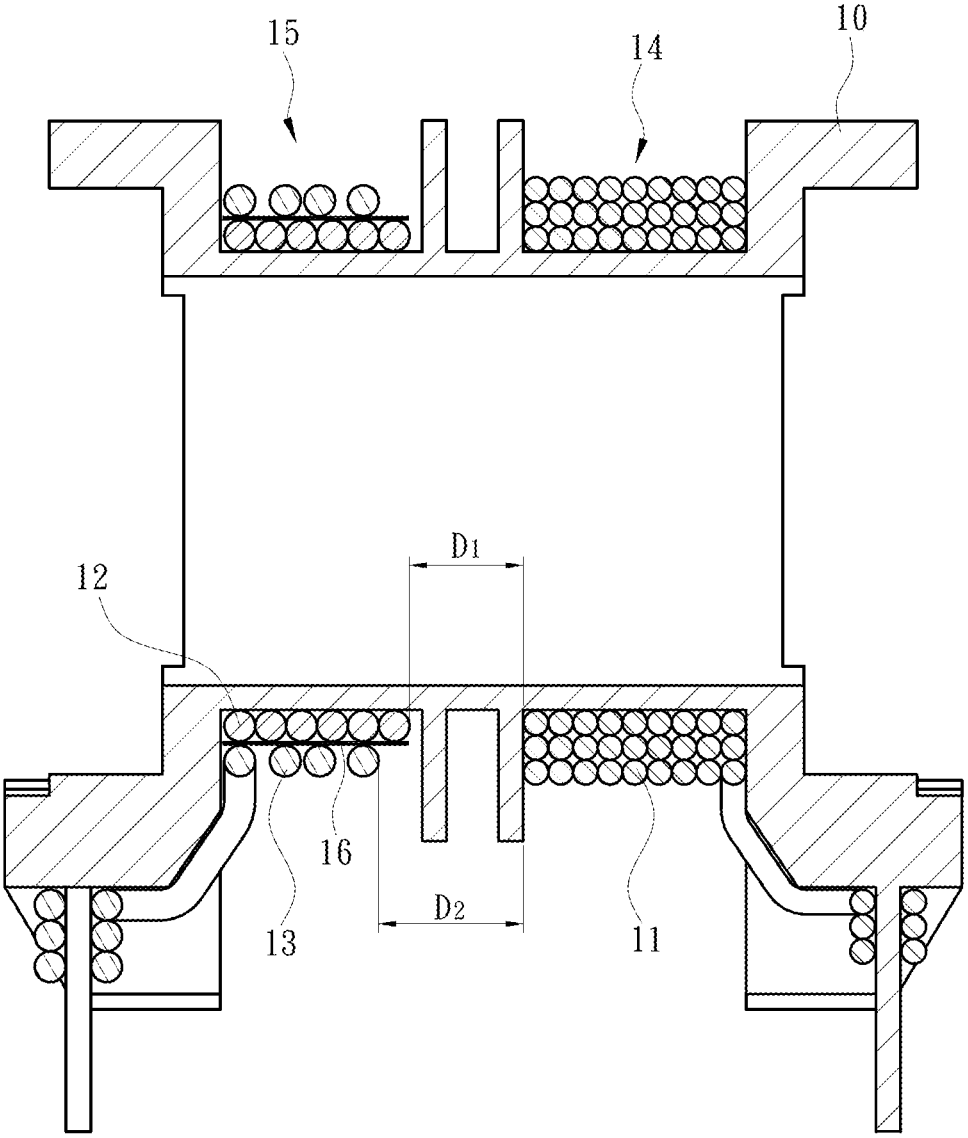
FIG. 1 is a section schematic diagram of a conventional transformer structure.
Figure 2:
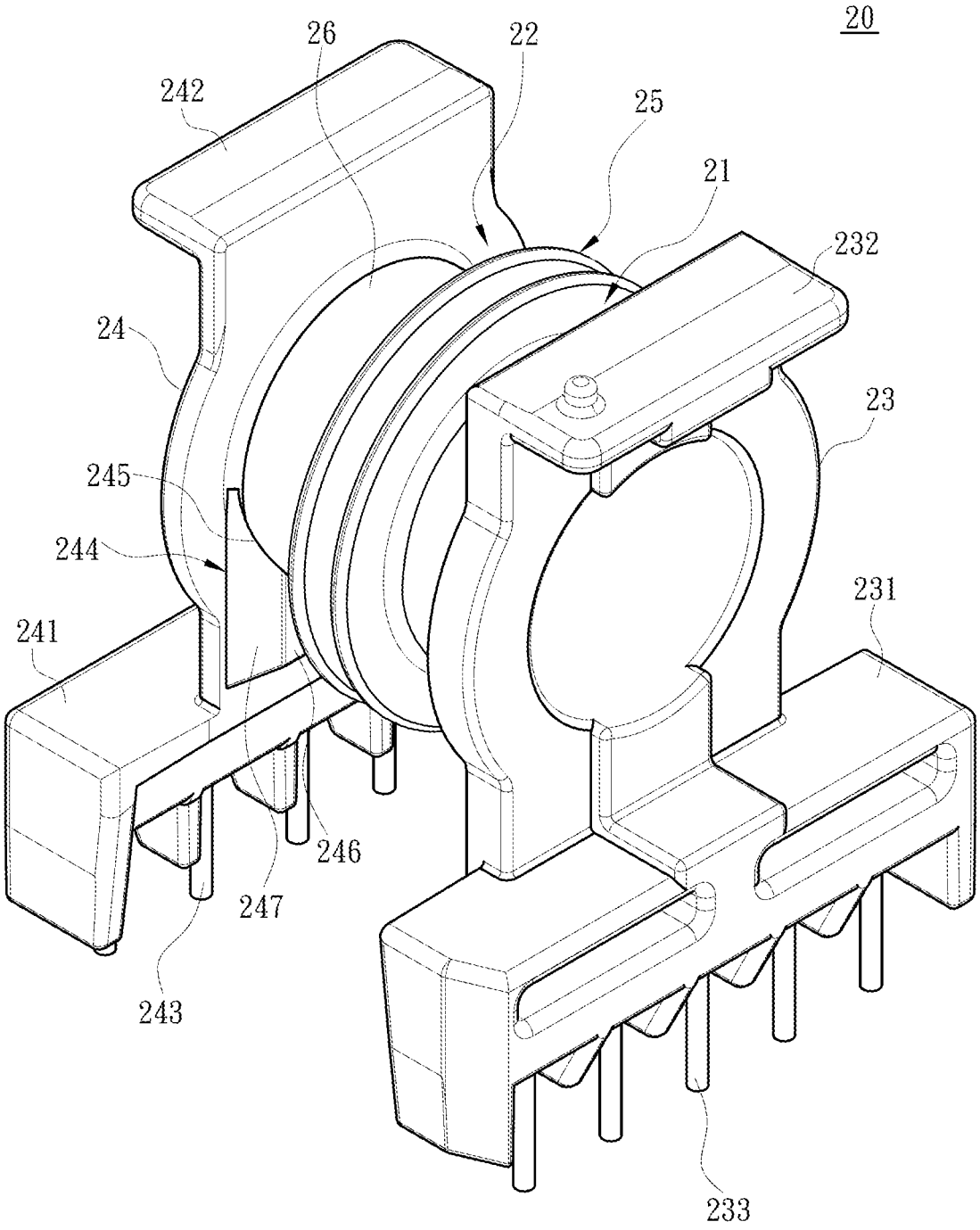
FIG. 2 is a perspective schematic diagram of a wire frame of the present invention from a first viewing angle.
Figure 3:
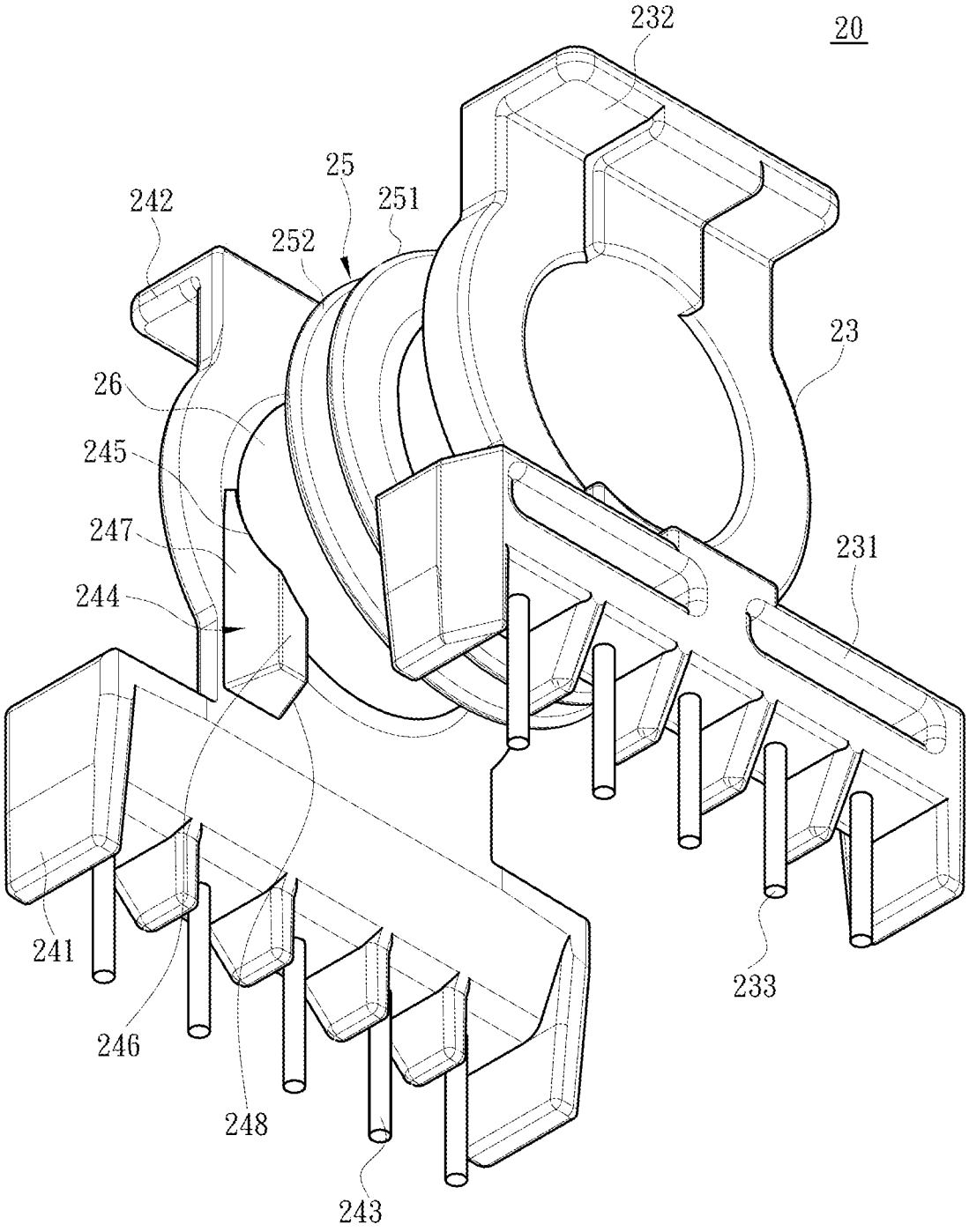
FIG. 3 is a perspective schematic diagram of a wire frame of the present invention from a second viewing angle.
Figure 4:
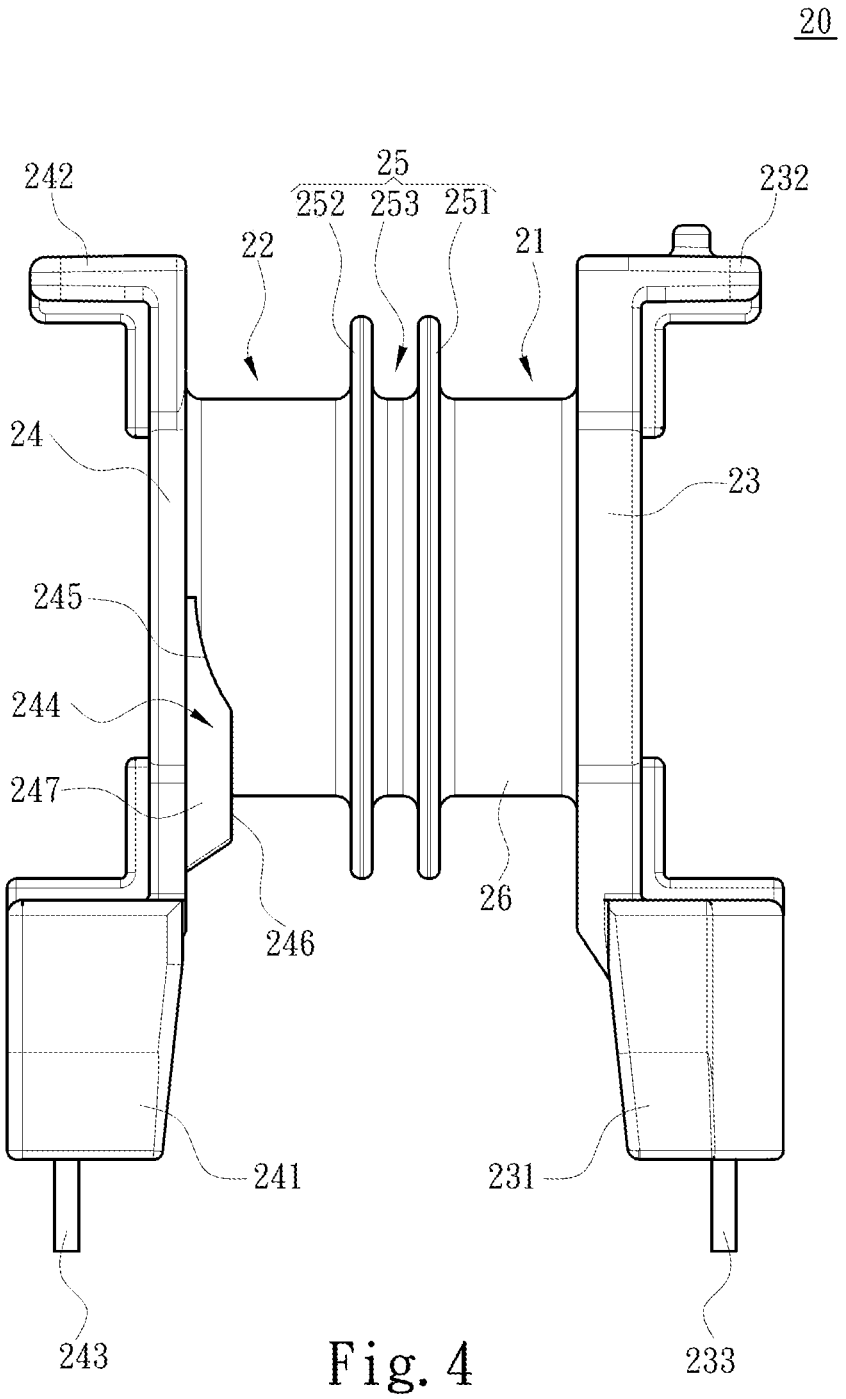
FIG. 4 is a side schematic diagram of a wire frame of the present invention.

Referring to FIGS. 2, 3, 4, and-5, as shown in the drawings, the present invention provides a transformer winding structure for enhancing winding stability. The transformer winding structure includes a wire frame 20, a first wire group 30, a second wire group 40 and a third wire group 50.

The wire frame 20 is defined with a first winding area 21 for winding the first wire group 30, and a second winding area 22 for winding the second wire group 40 and the third wire group 50. More specifically, the wire frame 20 is formed by a first plate 23, a second plate 24, and a winding column 26 for connecting the first plate 23 and the second plate 24 and having a spacer portion 25, such that the first plate 23 is opposite to the second plate 24. The first winding area 21 refers to an area on the winding column 26 and between the spacer portion 25 and the first plate 23, and the second winding area 22 refers to an area on the winding column 26 and between the spacer portion 25 and the second plate 24. Two ends of the first plate 23 are respectively a first wire outlet 231 and a first top end 232 opposite to the first wire outlet 231. Two ends of the second plate 24 are respectively a second wire outlet 241 and a second top end 242 opposite to the second wire outlet 241. Further, the first wire outlet 231 of the first plate 23 further includes a plurality of first electrodes 233 spaced from one another, and the second wire outlet 241 of the second plate 24 similarly includes a plurality of second electrodes 243 spaced from one another. The second plate 24 comprises a protrusion 244 which protrudes from the second plate 24 toward the first plate 23. The protrusion 244 is provided in a protruding manner in the second winding area 22. Further, the protrusion 244 has a connecting curved surface 245 connected to the winding column 26, a leveled surface 246 parallel to the second plate 24, and two side surfaces 247, 248 respectively located on one side of the leveled surface 246 and connected to the second plate 24. One of the two side surfaces 247, 248 that is away from the winding column 26 is an inclined surface. The protrusion 244 in fact can be an integral component of the wire frame 20, in a way that the connecting curved surface 245 is formed along a contour of the winding column 26. Further, the side surface 247 as an inclined surface can guide a winding path of the second wire group 40, allowing the second wire group 40 to be guided to be provided on the leveled surface 246. Further, the spacer portion 25 is provided between the first plate 23 and the second plate 24, and includes a first spacer plate 251 and a second spacer plate 252 opposite to the first spacer plate 251. A leakage inductance adjustment gap 253 is formed between the first spacer plate 251 and the second spacer plate 252. The first spacer plate 251 and the first plate 23 are adjacent and thus form the first winding area 21 therebetween, and the second spacer plate 252 and the second late 24 are adjacent and thus form the second winding area 22 therebetween.

Figure 5:
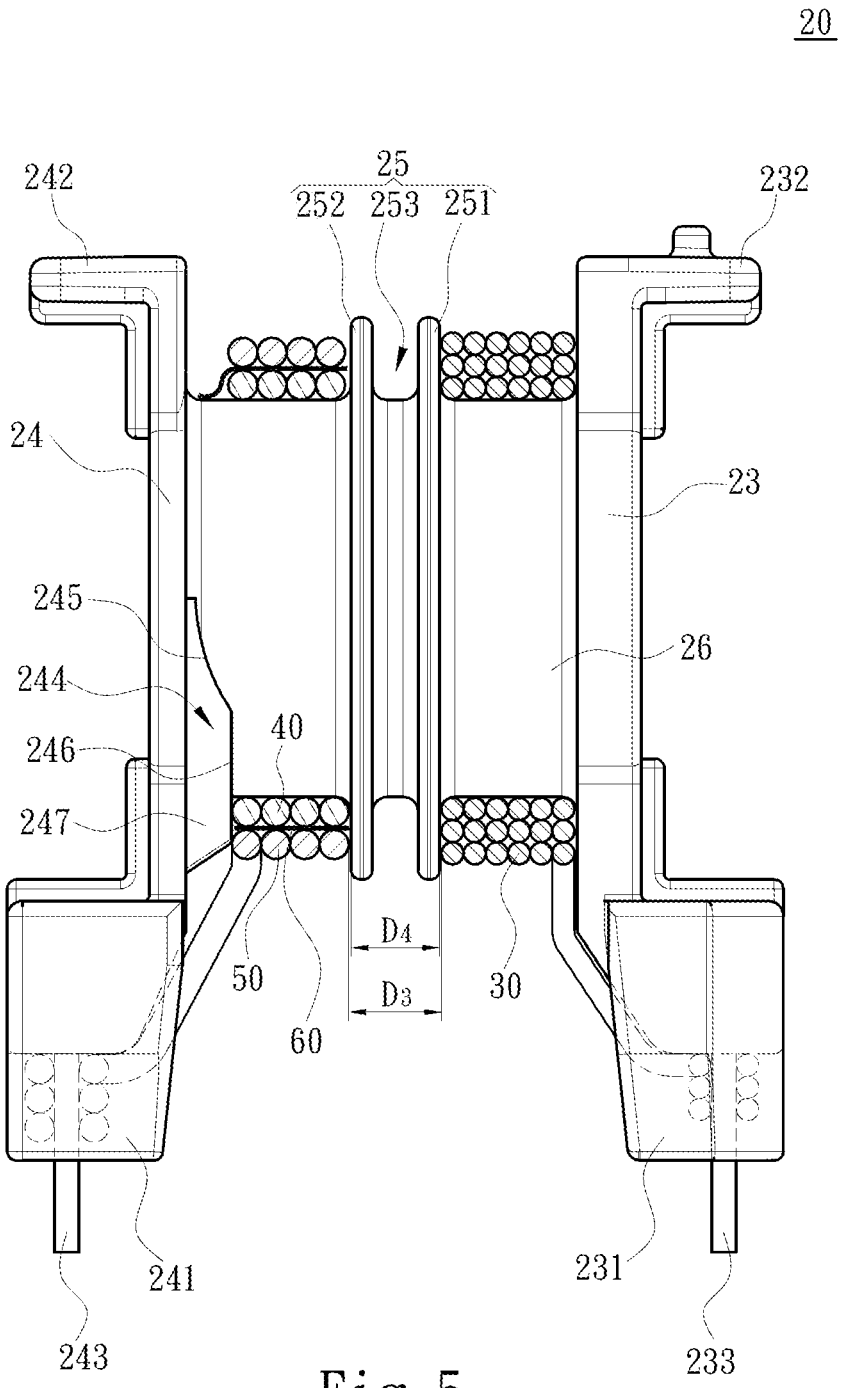
FIG. 5 is a section schematic diagram of the present invention.

As shown in FIGS. 4 and 5, to respectively wind the first wire group 30, the second wire group 40 and the third wire group 50 on the first winding area 21 and the second winding area 22, one end of the first wire group 30 is first wound on one of the first electrodes 233, and the first wire group 30 is wound on the winding column 26 in the first winding area 21. When the first wire group 30 is completely wound in the first winding area 21, the other end of the first wire group 30 is then wound on another of the first electrodes 233, such that the first wire group 30 can be positioned in the first winding area 21, and be electrically connected to the first electrodes 233.

After the first wire group 30 is completely wound in the first winding area 21, one end of the second wire group 40 is first wound on one of the second electrodes 243, and the second wire group 40 is wound on the winding column 26 in the second winding area 22. When the second wire group 40 is wound in the second winding area 22, the winding path inevitably passes through the protrusion 244, and the second wire group 40 overlays the leveled surface 246 and approaches the spacer portion 25 under the effect of the protrusion 244. After the second wire group 40 is completely wound, the other end of the second wire group 40 is wound on another of the second electrodes 243, allowing the second wire group 40 to be fixed in the second winding area 22 and be electrically connected to the second electrodes 243. Next, an insulation tape 60 can be applied on the second wire group 40 before the third wire group 50 is wound. One end of the third wire group 50 is similarly first wound on one of the second electrodes 243, the third wire group 50 is wound in an overlaying manner on the second wire group 40, and the winding of the third wire group 50 completed when a predetermined number of turns is achieved. The other end of the third wire group 50 is then wound to another of the second electrodes 243.

It should be noted that, because the protrusion 244 on the second plate 24 extends toward the second winding area 22, the second wire group 40 and the third wire group 50 are limited by the protrusion 244 and naturally approach the direction of the second spacer plate 252 when the second wire group 40 and the third wire group 50 are wound in the second winding area 22, hence increasing the winding stability. Thus, a first distance D3 between the second wire group 40 and the first wire group 30 can be similar to a second distance D4 between the third wire group 50 and the first wire group 30, in a way that the leakage inductance generated by the second wire group 40 and the first wire group 30 does not differ much from the leakage inductance generated by the third wire group 50 and the first wire group 30. More specifically, the difference is reduced. Further, experimentation is conducted using the structure of the present invention and a conventional structure, with the experimentation results as shown in Table 1. From Table 1, it can be better understood that the present invention particularly avoids the issue of an apparent difference between the leakage inductance generated by the second wire group 40 and the first wire group 30 and the leakage inductance generated by the third wire group 50 and the first wire group 30.

TABLE 1

Comparison table of leakage inductance of transformer winding structure of present invention and conventional transformer winding structure

| | Present invention | | | Conventional structure | | |
|---|---|---|---|---|---|---|
| No. | Leakage inductance formed between second wire group and first wire group | Leakage inductance formed between third wire group and first wire group | Difference | Leakage inductance formed between second wire group and first wire group | Leakage inductance formed between third wire group and first wire group | Difference |
| 1 | 162.9 | 163.5 | −0.6 | 168.0 | 156.0 | 12.0 |
| 2 | 161.2 | 164.2 | −3.0 | 170.0 | 158.0 | 12.0 |
| 3 | 163.4 | 161.1 | 2.3 | 165.0 | 152.0 | 13.0 |
| 4 | 162.7 | 158.2 | 4.5 | 167.0 | 155.0 | 12.0 |
| 5 | 164.6 | 157.7 | 6.9 | 170.0 | 158.0 | 12.0 |
| 6 | 161.8 | 158.3 | 3.5 | 170.0 | 156.0 | 14.0 |
| 7 | 165.8 | 159.6 | 6.2 | 173.0 | 155.0 | 18.0 |
| 8 | 157.5 | 162.5 | −5.0 | 170.0 | 155.0 | 15.0 |
| 9 | 160.9 | 159.8 | 1.1 | 170.0 | 157.0 | 13.0 |
| 10 | 162.5 | 157.2 | 5.3 | 170.0 | 157.0 | 13.0 |

What is claimed is:

1. A transformer winding structure for enhancing winding stability, the transformer winding structure comprising:

a wire frame, comprising a first plate, a second plate opposite to the first plate, a winding column connected to the first plate and the second plate, and a spacer portion provided in a protruding manner on the winding column, wherein the spacer portion and the first plate form a first winding area therebetween, the spacer portion and the second plate form a second winding area therebetween, and the second plate comprises at least one protrusion protruding from the second plate toward the first plate and having a connecting curved surface connected to the winding column, a leveled surface parallel to the second plate, and two side surfaces respectively located on one side of the leveled surface and connected to the second plate;

a first wire group, wound in the first winding area;

a second wire group, wound in the second winding area, wherein the second wire group approaches the spacer portion when passing through a position of the protrusion; and a third wire group, located in the second winding area and wound in an overlaying manner on the second wire group, wherein the third wire group approaches the spacer portion when passing through the position of the protrusion.

2. The transformer winding structure for enhancing winding stability of claim 1, wherein one of the two side surfaces that is away from the winding column is an inclined surface.

3. The transformer winding structure for enhancing winding stability of claim 1, wherein the transformer winding structure comprises a plurality of first electrodes provided on the first plate and a plurality of second electrodes provided on the second plate.

4. The transformer winding structure for enhancing winding stability of claim 3, wherein the first plate comprises a first wire outlet and a first top end opposite to the first wire outlet, and the plurality of first electrodes are provided at the first wire outlet.

5. The transformer winding structure for enhancing winding stability of claim 3, wherein the second plate comprises a second wire outlet and a second top end opposite to the second wire outlet, and the plurality of second electrodes are provided at the second wire outlet.

6. The transformer winding structure for enhancing winding stability of claim 1, wherein the spacer portion comprises a first spacer plate and a second spacer plate, and a leakage inductance adjustment gap is formed between the first spacer plate and the second spacer plate.

7. The transformer winding structure for enhancing winding stability of claim 6, wherein the first spacer plate and the first plate are adjacent, and the second spacer plate and the second plate are adjacent.

* * * * *